United States Patent [19]

Alley

[11] Patent Number: 4,930,554

[45] Date of Patent: Jun. 5, 1990

[54] SANITARY COVER FOR A LIQUID DISPENSER

[76] Inventor: Kenneth A. Alley, Rd. #4, Box 4820, Berwick, Pa. 18603

[21] Appl. No.: 183,786

[22] Filed: Apr. 20, 1988

[51] Int. Cl.[5] ..... B65B 3/04

[52] U.S. Cl. ..... 141/97; 141/98; 141/390; 141/391; 222/129.1

[58] Field of Search ..... 141/97.1, 98.311 R, 141/84, 129, 390, 391, 174; 222/129.1, 129.4, 129; 312/1, 209, 237, 349, 250; 221/191, 194, 193, 195, 199

[56] References Cited

U.S. PATENT DOCUMENTS

| | | | |
|---|---|---|---|
| 778,606 | 12/1904 | Price | 141/97 X |
| 1,082,327 | 12/1913 | Henvis | 141/174 |
| 2,472,921 | 6/1949 | Quimper | 141/174 |
| 2,591,507 | 4/1952 | Brous | 141/174 |
| 2,633,959 | 4/1953 | Von Stoeser | 221/199 X |
| 2,995,158 | 8/1961 | Oberg | 141/174 |
| 3,543,812 | 12/1970 | Friedman | 141/103 |
| 3,913,792 | 10/1975 | Brill et al. | 222/144.5 |
| 3,955,713 | 5/1976 | Hurley | 222/129.4 |
| 4,042,287 | 8/1977 | Hallen | 312/209 |
| 4,270,673 | 6/1981 | Rodth | 222/129.3 |
| 4,478,357 | 10/1984 | Jenkins | 222/135 |
| 4,485,940 | 12/1984 | Brown | 222/129.1 |
| 4,555,045 | 11/1985 | Rodth et al. | 222/1 |
| 4,590,975 | 5/1986 | Credle, Jr. | 141/1 |
| 4,688,701 | 8/1987 | Sedam | 222/129.1 |

*Primary Examiner*—Ernest G. Cusick

[57] ABSTRACT

A sanitary cover for a liquid dispenser, such as a typical soft drink dispenser is provided. A typical soft drink dispenser includes a nozzle assembly and an adjacent actuator where a diluent such as carbonated water is mixed with a beverage concentrate or syrup to produce a soft drink. The present invention provides a cover for the dispensing area of a conventional beverage dispenser which allows a user or consumer to manipulate, through a hand slot, a cup behind the cover in order to fill the cup at the beverage dispenser. The sanitary cover includes a cup inlet which discourages the insertion of a full or partially full cup. The outlet of the cover allows a full cup to be removed from the casing but discourages insertion of a full or partially full cup. The cover, thus, prevents a soiled cup from contacting the beverage dispensing nozzle or actuator assembly. The cover also provides shielding of the actuator and dispensing nozzle area of a beverage dispenser for sanitary reasons.

14 Claims, 2 Drawing Sheets

SANITARY COVER FOR A LIQUID DISPENSER

BACKGROUND OF THE INVENTION

The present invention relates generally to sanitary covers for liquid dispensers. More particularly, the present invention relates to a cover for a beverage dispenser which controls access to the fluid outlet nozzles and actuator assembly of the beverage dispenser. Typical beverage dispensers with which the present invention may be employed are those in which a diluent (such as carbonated water) is mixed with a beverage concentrate or syrup to produce a soft drink.

Such beverage dispensers typically include an actuator assembly which is contacted by a cup oriented under the fluid outlet nozzle. The actuator assembly operates solenoids which control the flow of diluent and syrup to be dispensed. For example, U.S. Pat. Nos. 4,483,940 issued to Brown; 4,555,045 issued to Rodth et al and 4,688,701 issued to Sedam disclose typical dispensers and dispenser actuator assemblies.

Such dispensers have proliferated in the food service industry with the growth of the soft drink industry. In many fast food and convenience stores, such dispensers have been put into self-service use where the customer is free to operate the dispenser. Such self-service use of a typical beverage dispenser has raised concerns of a sanitary nature.

The exposed beverage nozzle and actuator assembly can pose problems of a sanitary nature in both a controlled and self-service environment. Often a customer will fill a cup, drink and immediately "top off" the cup raising serious concerns with the respect to the continued use of such dispensers in a self-service setting for public health reasons. Also, the relatively open and exposed nature of the typical design of a beverage dispenser is less than desirable from a sanitary stand point.

SUMMARY OF THE INVENTION

The present invention provides a cover or casing which controls access to the beverage nozzle and actuator assembly area of a typical beverage dispenser. The present invention allows the operator, or the customer in a self-service setting, to fill an empty cup at a beverage dispenser while limiting access to the dispensing nozzle and actuator assembly area. The present invention controls access to the dispenser nozzle and actuator assembly to discourage a consumer from drinking from a cup and then "topping off" the cup. Also, the present invention provides increased shielding for the beverage dispensing nozzles and actuator assemblies for sanitary purposes. The present invention shields the liquid dispensing nozzles and actuator assembly of a beverage dispenser without impeding operation of the beverage dispenser.

The present invention allows a user or consumer to manipulate a cup behind a cover or case which encloses the dispensing nozzle area, fill the cup and remove the full cup from the cover or casing at an outlet. The present invention discourages the insertion of a cup at the casing outlet and the casing inlet discourages the insertion of a full or partially full cup into the cover or casing. In the preferred embodiment, the cover or casing encloses a cup dispenser so that a soiled cup may not be filled at the beverage dispenser.

DESCRIPTION OF THE PREFERRED EMBODIMENT

Figure 1:
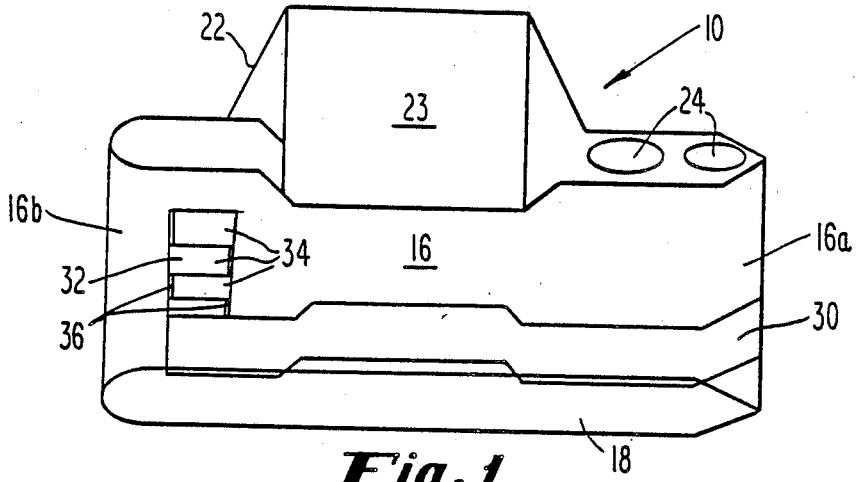
FIG. 1 is a front perspective view of the sanitary cover of the present invention.

Although specific forms of the invention have been selected for illustration in the drawings, and the following description is drawn in specific terms for the purpose of describing these forms of the invention, this description is not intended to limit the scope of the invention which is defined in the appended claims.

The present invention comprises a casing or cover 10 which is adapted to mate with a typical beverage dispenser 12, enclosing the beverage nozzle and actuator assemblies 14 of the beverage dispenser 12. The casing 10 includes a front cover or panel 16 having a base 18 adapted to interfit with the drain area 20 of a typical beverage dispenser 12. The sides of front face 16 are shaped to wrap around or interfit with the edges of the dispenser 12.

A top 22 of the casing 10 includes a clear or transparent section 23 which allows the user to view the dispenser area 14 of the beverage dispenser 12 when the casing 10 is oriented thereabout.

Figure 2:
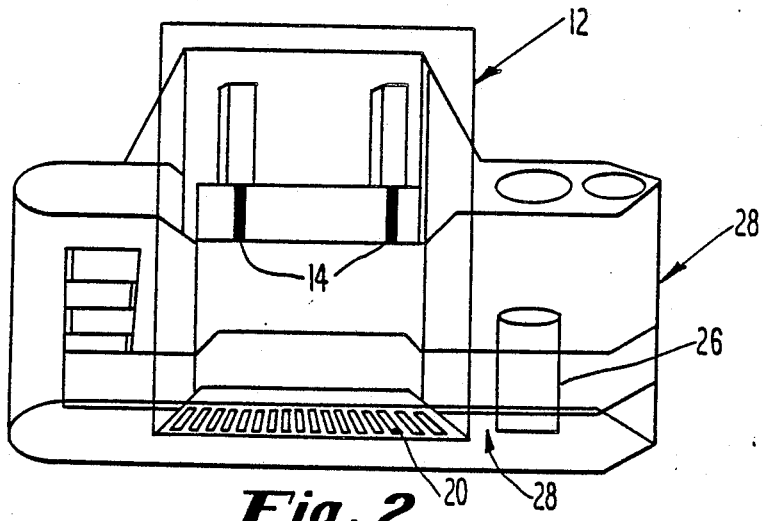
FIG. 2 is a front perspective view of the present invention oriented around a beverage dispenser.

A first side **16*a* of the front face 16 includes openings 24 through the top 22 through which cups may be inserted when the casing 10 is mated with a beverage dispenser 12 as shown in FIG. 2. Preferably, a plurality of openings 24** of varying size are provided to allow the use of cups of varying dimensions.

The openings 24 allow a cup 26 to be dropped there through and into the interior of the casing. The openings 24 are oriented so as to require a consumer to drop a cup into the casing which discourages the consumer from inserting a full or partially full cup into the casing.

The inserted cup 26 drops into a receiving area 28 where the consumer can reach the cup 26. The consumer reaches the cup 26 through a hand opening or slot 30 which extends laterally across the face 16 of the casing 10. The opening 30 allows the consumer to reach a hand into the casing 10 and grasp the cup 26. The consumer may then move his hand, grasping the cup 26, within the casing 10, laterally across opening 30 to operate the beverage dispenser 12 in a conventional manner. The laterally extending slot 30 allows the consumer to manipulate a cup 26 under the desired beverage dispensing nozzle 14, activate the actuator assembly and fill the cup 26.

Thereafter, the consumer moves the cup laterally to a second side **16*b* of casing 10 toward outlet opening 32. Outlet opening 32 allows the full cup to be removed from the casing while preventing insertion of a cup there through. Preferably, the cup outlet 30 includes a plurality of flaps or arms 34. The flaps or arms 34 are fixed to the front face 16 of casing 10 by one-way hinges 36 which allow the flaps or arms 34 to swing outwardly toward the consumer when a cup is being removed but which prevent the flaps or arms 34 from swinging inwardly toward the beverage dispenser 12. The swinging flaps 34, thus, discourage the insertion of a full or partially full cup through the outlet opening 32. Preferably, adjacent flaps are affixed to the front face 16 of casing 10 at alternate, opposite edges as shown in FIG. 1 to discourage the consumer from pulling the hinged flaps 34 outwardly and inserting a full or partially full cup through the opening 32**.

Figure 3:
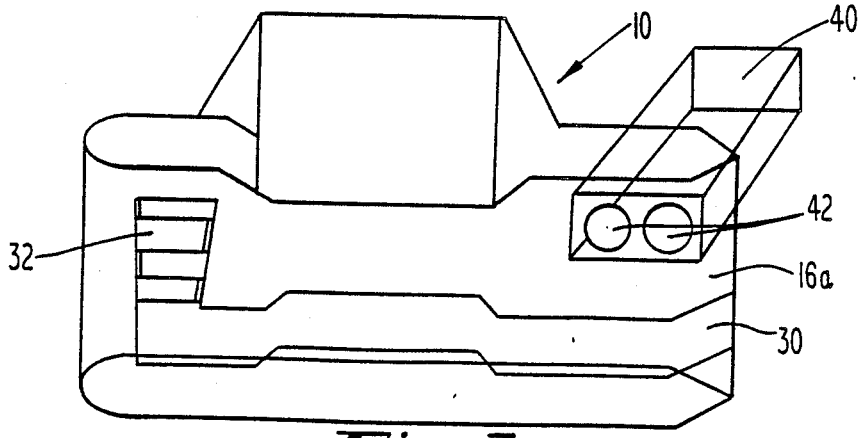
FIG. 3 is a front perspective view of an alternate embodiment of the present invention.

FIG. 3 shows an alternate embodiment of casing 10 in which a cup dispenser 40 is oriented at the first end 16*a* of the casing 10. The cup dispenser 40 includes a plurality of openings 42 which provide access to a stack of cups (not shown) oriented within the cup dispenser 40. The openings 42 are oriented adjacent the hand slot 30 in casing 10. This allows a consumer to reach through hand slot 30, select the desired size of cup, move the cup laterally behind the cover 10 to the beverage dispensing area and when the cup is filled and remove the cup from outlet 32 as described above. Since, unlike the embodiments depicted in FIGS. 1, 2 and 4, ice cannot be placed in the cup before the cup is placed in the cup dispenser of the embodiment depicted in FIG. 3, it is preferred that the casing 10 of the FIG. 3 embodiment be configured to enclose an ice dispenser as well as the beverage dispenser if the use of such an ice dispenser is contemplated.

Figure 4:
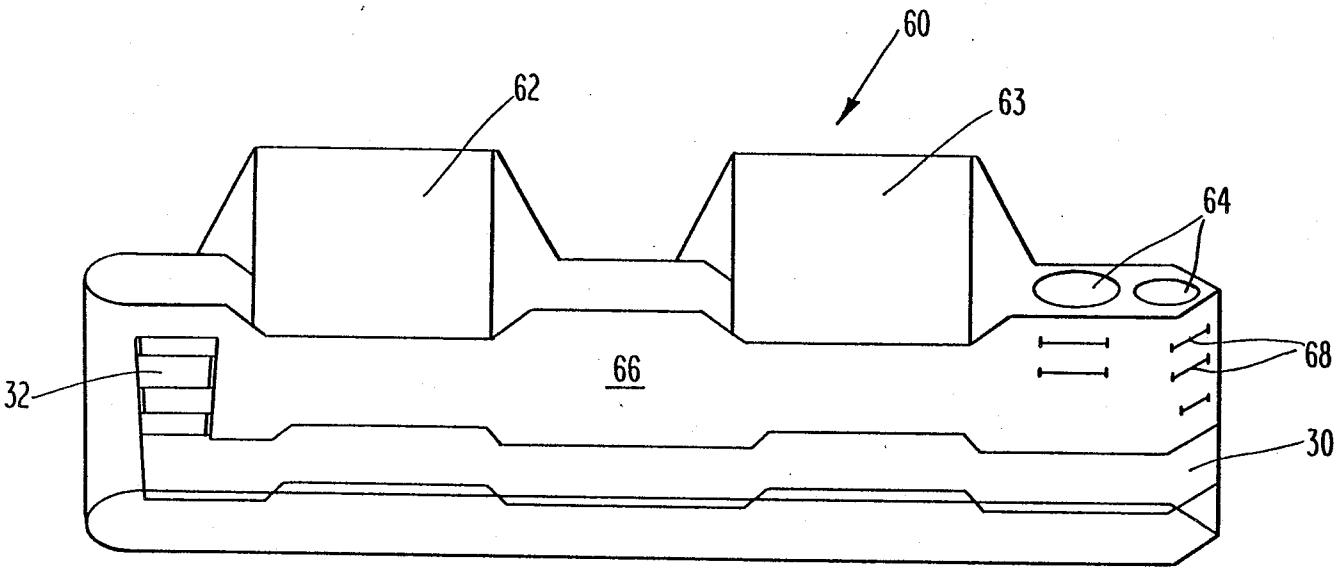
FIG. 4 is a front perspective view of an alternate embodiment of the present invention.

FIG. 4 shows an alternate embodiment of the present invention adapted to be employed with a beverage dispenser having multiple dispensing areas. The cover 60 shown in FIG. 4 includes two clear viewing areas 62 and 63, and a laterally extending hand slot 30 and cup outlet 32 as described above. Oriented on the interior surface of the front face 66 of the cover 60 adjacent the openings 64 for cups, are lips or ridges 68. The lips or ridges catch the widest top portion of a cup which is dropped through openings 64 in order to minimize cups falling sideways as they are dropped through the cup openings 64. Other cup alignment means, such as flexible extending fingers or a guide means (not shown) may be employed adjacent the cup openings of the apparatus of the present invention.

Upon dropping a cup through the openings 64, the consumer reaches through slot 30, grasps the cup and moves it laterally to the first dispensing area of the beverage dispenser oriented behind viewing panel 63. Typically the first dispensing area of a such a multiple dispensing area beverage dispenser comprises an ice dispenser.

The consumer, thereafter, grasping the cup through slot 30 moves the cup laterally to the second dispensing area 62 which is typically the beverage dispensing area. The consumer selects the desired beverage, fills the cup and removes the cup through outlet 32 as described above.

The casing 10 or 60 of the present invention may be adapted to fit around or encase a wide variety of beverage dispensers on the market. The present invention, thus, not only discourages a consumer making use of a self-serve beverage dispenser from "topping off" a cup after drinking from the cup, but also provides increased coverage of the liquid dispensing nozzles and actuator assemblies in a controlled environment, such as a restaurant, for sanitary reasons.

The casing of the present invention may be molded from a rigid clear or transparent plastic such as polyethylene or formed from a combination of metal and plastic or glass pieces. As discussed above, the area of the casing adjacent the beverage dispensing nozzles and actuator assemblies is preferably clear or transparent in order to allow the consumer or operator to view the dispensing nozzles and actuator assemblies. As would be recognized by a person skilled in the art, the overall dimensions and shape of the cover can be easily modified in order to mate with the particular beverage dispenser with which it will be employed. Sanitary covers including the new and novel features discussed above may be easily provided for the wide variety of beverage dispensers currently on the market, as well as those of the future.

It should be understood that the foregoing descriptions of the present invention are not intended to be limiting, but are only exemplary of the inventive features which are defined in the claims.

What is claimed is:

1. A cover for a enclosing a dispensing area of a liquid dispenser for dispensing liquid into a cup, comprising:

(a) a casing means adapted for enclosing the dispensing area of a liquid dispenser wherein said enclosed dispensing area includes a region adapted for disposing said cup during filling of said cup;

(b) a hand opening through said casing means adapted to be sufficiently large in the dispensing area to pass a hand therethrough and sufficiently small to prevent passage of said cup therethrough extending laterally across said casing means from a first side to a second side; and (c) a cup receiving means oriented adjacent said hand opening at said first side and cup outlet means oriented at said second side of said hand opening.

2. The cover of claim 1, wherein said casing means includes a transparent viewing area adapted to be adjacent a liquid outlet nozzle and actuator assembly area of said liquid dispenser.

3. The cover of claim 1, wherein said cup receiving means comprises an opening in said casing means adjacent said first side, adapted to orient a cup dropped therethrough adjacent said hand opening.

4. The cover of claim 1, wherein said cup receiving means comprises a cup dispenser means which is adapted for orienting a cup adjacent said hand opening at said first side of said casing means.

5. The cover of claim 1, wherein said cup outlet means comprises an opening in said casing means at said second end including means adapted to allow passage of said cup out of said casing means in a first direction while preventing passage of said cup into said casing means in a second direction.

6. The cover of claim 5, wherein said outlet means comprises a plurality of flaps affixed to said casing means by one way hinges.

7. The cover of claim 6, wherein adjacent flaps are fixed to said casing means at alternating opposite edges.

8. An improved beverage dispenser of the type wherein a diluent and a beverage syrup are mixed to provide a beverage upon operation of an actuator assembly oriented adjacent a nozzle assembly at a dispensing area wherein the improvement comprises a cover enclosing the dispensing area of said beverage dispenser wherein said enclosed dispensing area includes a region adapted for disposing a cup during filling of said cup, said cover having a hand opening adapted to be sufficiently large in the dispensing area to pass a hand therethrough and sufficiently small to prevent passage of said cup therethrough, said opening extending laterally across said cover from a first side having a cup receiving means to a second side having a cup outlet mans.

9. The improved beverage dispenser of claim 8, wherein said cover includes a transparent viewing area adjacent said actuator assembly and said nozzle assembly.

10. The improved beverage dispenser of claim 8, wherein said cup receiving means comprises an opening in said cover adjacent said first side, adapted to orient a cup dropped therethrough adjacent said hand opening.

11. The improved beverage dispenser of claim 8, wherein said cup receiving means comprises a cup dispenser means which is adapted for orienting a cup adjacent said hand opening at said first side of said cover.

12. The improved beverage dispenser of claim 8, wherein said cup outlet means further comprises an opening in said cover at said second end, including means adapted to allow passage of said cup out of said cover in a first direction and adapted to prevent passage of said cup into said cover in a second direction.

13. The improved beverage dispenser of claim 12, wherein said cup outlet means comprises a plurality of flaps fixed to said cover by one way hinges.

14. The improved beverage dispenser of claim 13, wherein adjacent flaps are affixed to said cover at alternating opposite edges.

* * * * *